US006272686B1

(12) United States Patent
Liu

(10) Patent No.: US 6,272,686 B1
(45) Date of Patent: Aug. 14, 2001

(54) GOLF GLOVE

(76) Inventor: Monica Liu, 1222 S. Mayflower Ave. #A, Monrovia, CA (US) 91016

( * ) Notice: Subject to any disclaimer, the term of this patent is extended or adjusted under 35 U.S.C. 154(b) by 0 days.

(21) Appl. No.: 09/137,203

(22) Filed: Aug. 20, 1998

(51) Int. Cl.[7] ..... A41D 19/00
(52) U.S. Cl. ..... 2/161.2; 2/161.1; 473/205
(58) Field of Search ..... 2/161.2, 20, 159, 2/160, 161.1, 161.3, 161.4, 168, 169; 473/205

(56) References Cited

U.S. PATENT DOCUMENTS 3,394,408 * 7/1968 Bush ..... 2/161.1
4,519,097 * 5/1985 Chappell, Jr. et al. ..... 2/161.1
5,232,225 * 8/1993 Snyder ..... 2/161.3
5,462,280 * 10/1995 Dickerson ..... 2/161.2
5,511,247 * 4/1996 Block ..... 2/161.1
5,542,126 * 8/1996 Harvanek ..... 2/161.2
5,644,795 * 7/1997 Landis et al. ..... 2/161.3
5,704,065 * 1/1998 Feuerhake ..... 2/161.2
5,836,828 * 11/1998 Sinton ..... 473/205

* cited by examiner

*Primary Examiner*—John J. Calvert
*Assistant Examiner*—Gary L. Welch
(74) *Attorney, Agent, or Firm*—Maria Erlinda C. Sarno

(57) ABSTRACT

This invention relates to a golf glove having a guide line drawn diagonally at an angle of 20–30 degrees from a horizontal line across the upper surface of the golf glove, the guide line passing through the crook between the roots of the middle finger and the ring finger. The guide line on the golf glove is used in combination with the indicium on the grip handle of the golf club for proper grip and positioning prior to swing.

10 Claims, 4 Drawing Sheets

GOLF GLOVE

BACKGROUND OF THE INVENTION

This invention relates to a golf glove with a guide line for use in combination with an indicia on a grip handle of a golf club to insure proper grip.

One of the fundamentals in the sport of golf is learning to properly position one's hand on the grip of the golf club and maintaining this proper grip while the golfer is actually swinging and attempting to hit a golf ball. A proper grip is one which correctly positions the golf club in the golfer's hands such that when the golfer swings the club to hit the ball, the golfer attains the desired result. Minor-mispositioning of the user's hand when gripping the handle of the club can significantly decrease the likelihood of a successful outcome in the execution of the swing.

Prior art gloves with grip training aids employ especially shaped hook and loop component fabrics of a separable fabric fastener to improve gripping on designated areas of the golf glove. Others employ padded areas and markings across the palm of the hand.

Although slips and twists of the handle are prevented by these grip guiding means, a player is likely to create a dependency on these aids because a physically detectable effect will be manifested when the grip slips such as a ripping sound on the fastened hook and loop material or absence/presence of sensation imparted by the paddings or raised surfaces on the palm of the hand as the player grips for the handle. Some hook and loop materials applied on the golf glove virtually restricts the hands from movements thereby robbing the player of the feel for the right grip and are cumbersome, as well, to release in between swings. These guiding means, do not provide the training in the more actual environment setting where the golfer attains the right positioning guided by a means such as provided by this invention which give the player the opportunity to develop his independent acquisition of the right feel for the grip handle prior to swing.

It is an object of this invention to provide a golf glove with a guide line to show the exact placement of the golf club to insure proper gripping of the golf club shaft.

It is also an object of this invention to provide a golf glove with a guide line that is simple and inexpensive to apply.

It is also a further object of this invention to provide a golf glove that will more easily transition a novice to a proficient golfer.

SUMMARY OF THE INVENTION

This invention relates to a golf glove for use in combination with an indicium on a golf club grip handle to achieve proper golf grip position comprising a glove having an anterior and posterior surface; and, a guide line positioned diagonally across the anterior surface of the glove, the guide line passing through the crook between adjacent roots of the middle finger and the ring finger, sloped at an angle of 20–30 degrees from a phantom straight line drawn horizontally across the anterior surface of the golf glove and underlying the indicium on the grip handle of the golf club at approximately 180 degree position from the indicium. For ease of measuring the angle, the phantom line preferably intersects a point on the guide line below the small finger.

The guide line is applied across the anterior surface of the glove after the glove is assembled. The anterior surface of the gloves cover the anterior side or the palm area of the hand while the posterior surface covers the posterior side of the hand opposite the palm.

To achieve a proper grip of the golf club, a wearer of the golf glove having a guide line as described above, receives a golf club grip handle having an indicium on the anterior surface of the glove on the upper gripping hand or hand uppermost; superimposes the grip handle longitudinally over the guide line on the anterior surface of the glove; and, positions the indicium on the grip handle in a direction facing the golfer or wearer at approximately 180 degrees from the underlying guide line before gripping the club for the swing. Upper gripping hand or hand uppermost is the left hand on a right-handed golfer and vice-versa. The right or ungloved hand then grips the upper gripping hand and the club grip handle usually by overlapping or interlocking the small finger of the ungloved hand with the index finger of the upper gripping hand. Prior to swing, the player makes a quick glance to check his upper gripping hand to insure proper positioning of the indicium on the grip handle in relation to the guide line.

The drawings are directed to a left-hand glove for a right hand golfer, but it is obvious that the invention also covers right-hand gloves for left-handed golfers since the guideline applies to the upper gripping hand of a golfer regardless of whether or not he is right handed or left-handed. The guide line on the right hand will slope diagonally at the same range of angle, in the opposite direction of the guide line on the left-hand glove.

DETAILED DESCRIPTION OF THE INVENTION

Figure 1:
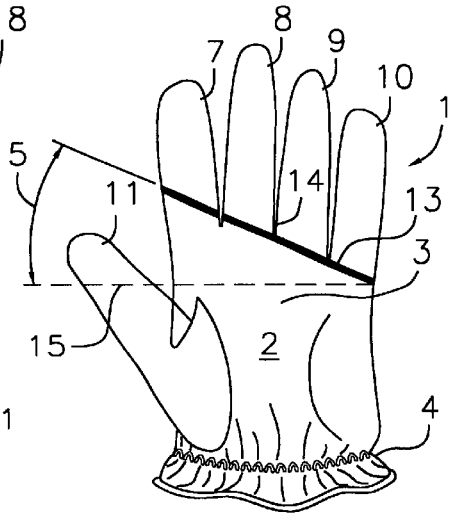
FIG. 1 is a plan view of the anterior surface of a golf glove showing the guide line and its position according to this invention.
Figure 2A:
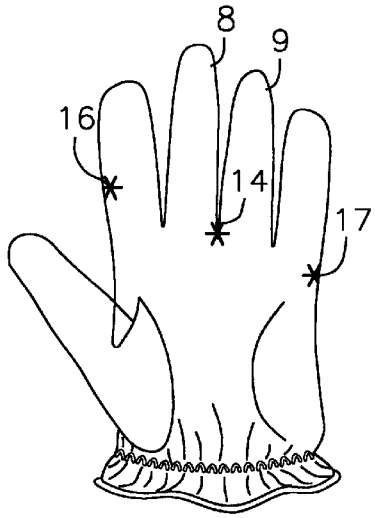
FIGS. 2*a*–2*d* show some alternate designs of the guide line.
Figure 2C:
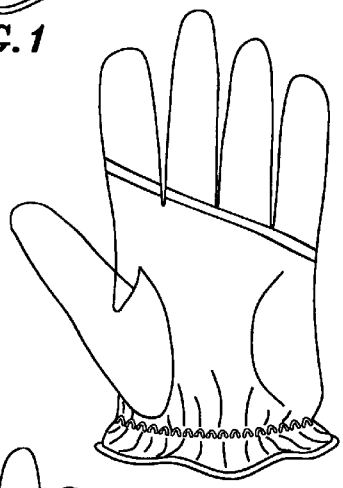
Figure 2B:
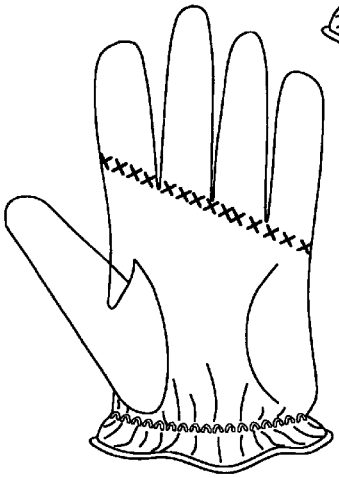
Figure 2D:
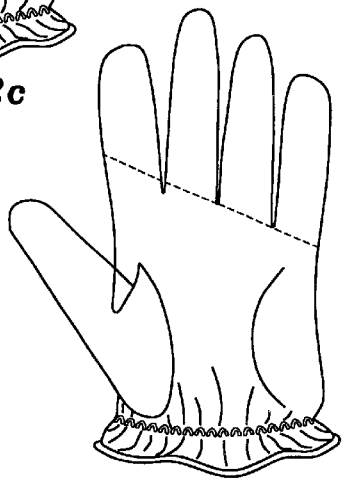

The golf glove 1 shown in FIG. 1 is a full fingered glove which includes a palm portion 2 on the anterior surface 3 of the glove, a wrist portion 4 on the open end of glove 1, and a finger portion on the opposite end of the glove. The finger portion 6 includes a plurality of separate fingers to accommodate the five fingers of a wearer, an index or forefinger 7, a middle finger 8, a ring finger 9, a pinky or little finger 10 and a thumb 11. Adjacent roots of the finger form a crook therebetween. The wrist portion 4 may be an elastic or non-elastic wrist band. The glove has an anterior surface 3 and a posterior surface 12 (not shown). On the anterior surface 3 of the glove, a guide line 13 is applied across the base of the finger portion, running diagonally through the crook 14 between adjacent roots of the middle finger 8 and the ring finger 9 as shown in FIG. 1. The guide line is angled 20–30 degrees 5 from a phantom line 15 originating from any point on the guide line 13 below the little finger 10 and extending horizontally straight across the anterior surface of the glove to the opposite end below the forefinger as shown in FIG. 1. The guide line 13 can be angled correctly through the use of a device such as a protractor by positioning the diagonal line through the crook 14 anywhere between 20–30 degrees of the protractor measured from the phantom straight line 15 which would be the adjacent side forming the 20–30 degree angle with the diagonal line. However, other known means are possible. The guide line 13 is a narrow line with a thickness of not more than one centimeter, preferably less than 5 millimeter. The guide line may be a plain straight line or constructed or drawn with a string of geometric shaped patterns and design such as circles, squares, triangles, diamonds, crosses, and others so long as it results in a line with the preferred thickness and slope or angle 5 from the phantom line. The core of this invention is to place the guide line on the gloves at approximately 180 degrees underneath the indicium/indicia on the club's grip handle. If the guide line is too broad, this will reduce precision in the positioning of the indicium on the grip handle over the guide line. Alternatively, the guideline may be represented by at least three dots as shown in FIG. 2*a,* with the principal dot located at the crook 14 between the adjacent roots of the middle 8 and ring finger 9, another dot 16 on the forefinger 7 and the other 17 dot below the little finger 10, such that when these three dots are connected, it will result in a diagonal line angled or sloped 20–30 degrees 5 from a phantom line running horizontally across the anterior surface 3 of the glove similar to the guide line shown in FIG. 1. Although this alternative is represented as dots, this can also be in the form of a star, asterisk, or other designs such as a flower and the like with a discernible midpoint. The guide line or dots and their equivalents may be applied to the anterior surface 3 of the glove by any means such as imprinting, stamping, attaching, gluing, drawing, sewing, stitching, silk screening and other means known in the art in such a manner as to cause no raised surface, even if raised surface may be used for non-regulated games. Other variations, although not fully represented, are shown in FIGS. 2*b,* 2*c,* and 2*d.* These guide means are preferably of a contrasting color from that of the glove so as to be easily discernible.

The glove may be constructed of any suitable material having an elastic nature, such as leather, transversely isotropic material sold under the tradename, ISOTONER, synthetic material such as knitted or woven acrylic material, wool, cotton, SPANDEX, and others, to help reduce sagging that occurs in gloves, due to repeated use.

The glove may be of any desired size to fit comfortably the hand of the wearer. A relatively tight-fit hand glove about the hand of the wearer, facilitates gripping of the handle. The hand glove is advantageously sized to the hand size of the wearer.

Figure 3:
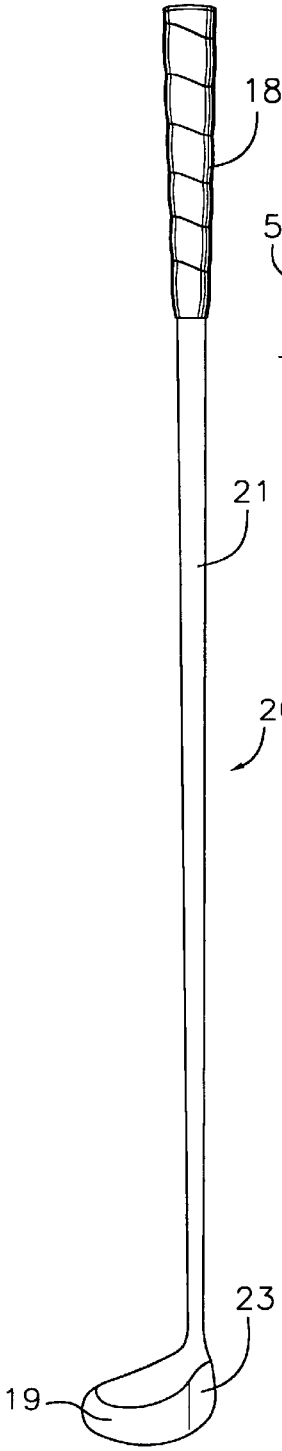
FIG. 3 is a plan view of the parts of a golf club.

Referring now to FIG. 3, there is shown the parts of a golf club 20, a club head 19 on one end and a grip handle 18 on the other end. Between these ends is the golf club shaft 21. Every grip handle 18 of a golf club has an indicium 22 which the manufacturers use to indicate the position where the face 23 of the golf club or putter is approximately 90 degrees from the ball or target line when the golf club is properly soled on the ground and its shaft, straight.

Figure 4:
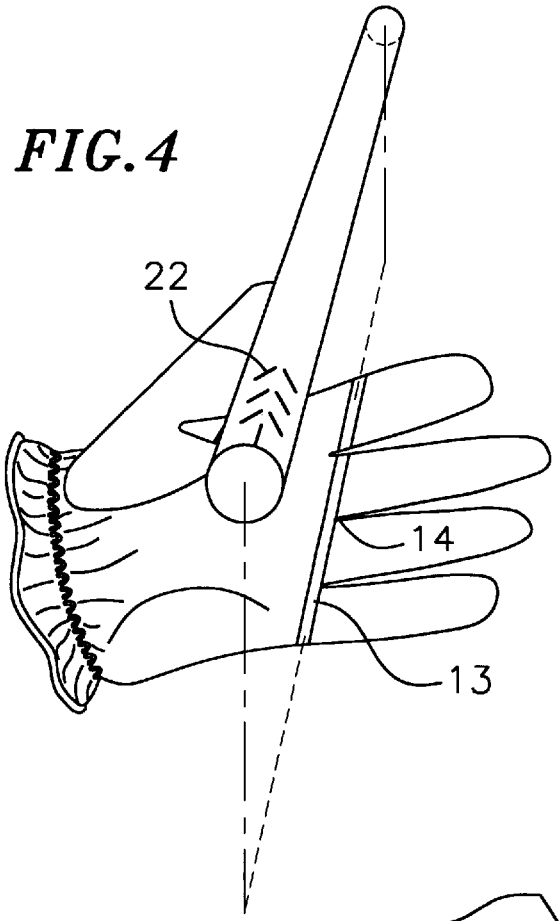
FIG. 4 is an exploded view showing the indicia on the golf club grip handle relative to the guide line on the glove with the indicia on the grip handle approximately 180 degrees from the guide line.
Figure 5:
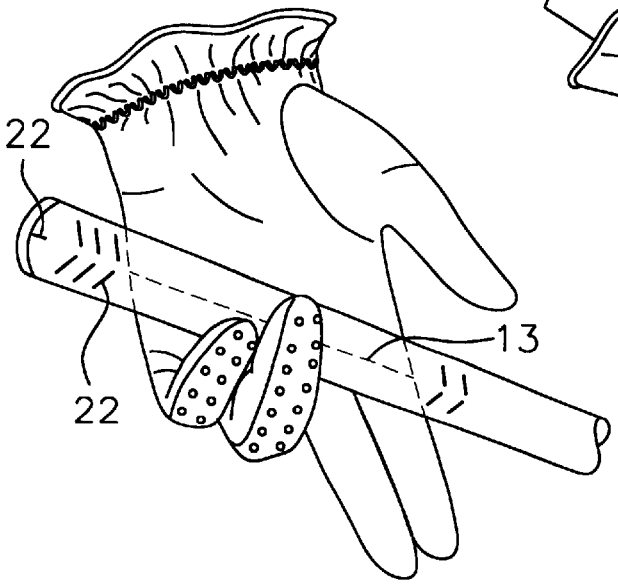
FIG. 5 is a plan view of the grip handle superimposing the guide line.

This invention places another function for these -Lndicia found on the grip handle 18. Applicant has found that guide line 13 when used in conjunction with an indicium/indicia printed, attached, stitched or etched on the grip handle 18 of a golf club 20 in a manner presented by this invention, will effect a proper grip on the golf club. It is shown herein that when guide line 13 underlie the grip handle 18, in such a manner that the indicium 22 on the grip handle is opposite guide line 13 with the rest of the grip handle lying longitudinally over the guide line when gripped as shown in FIGS. 4 and 5, a golfer achieves proper grip for an effective swing. It is to be expected that the invention of using the guide line on the glove with the indicium on the grip handle for proper positioning is only effective when the indicium on the grip handle is properly positioned. The indicium/indicia on the grip handle is properly positioned when the face of the golf club head or putter is approximately 90 degrees from the target line or ball and the indicium/indicia is approximately 180 degrees from the guide line.

Grip handles bear different forms of indicia, from as simple as a vertical line to more complex designs using portions of the manufacturer's logo. FIG. 6 shows some of these indicia. Thus, while particular shapes for the several indicia have been disclosed herein through the drawings, it will be appreciated that other shaped indicia, and also indicia of a variety of colors, can be used as well. For example, while arrow-shaped indicia 22 have been disclosed to show location for aligning the guide line 13 with the handle grip 18, other shapes having directional meaning such as lines, star, points, and crosses can also be used. The lines can also be constructed or drawn with a string of circles, squares, triangles and the like.

Figure 8:
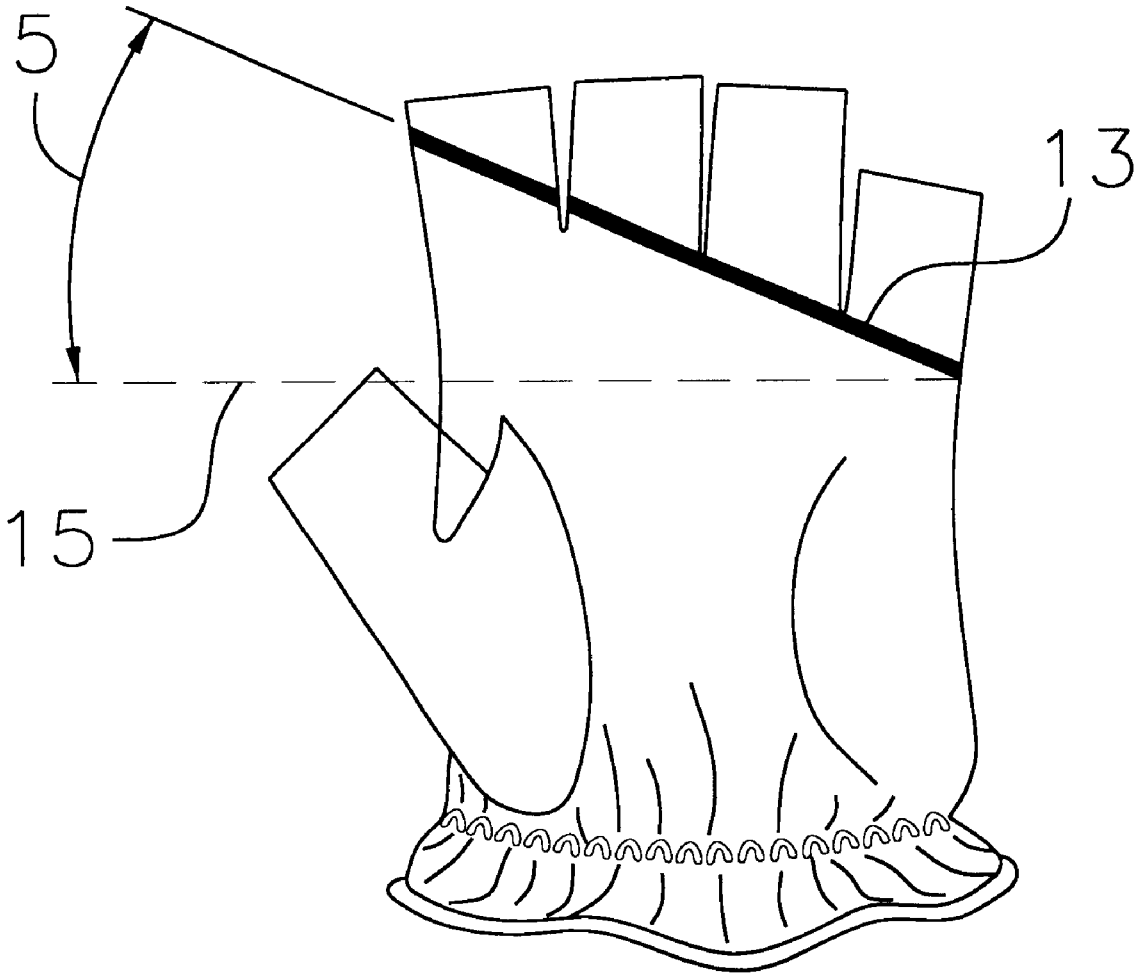
FIG. 8 is a plan view of the anterior surface of a partial golf glove.

While a full fingered glove is described above, a partial glove not covering the entire fingers may also be used as shown in FIG. 8. Furthermore, while the invention has been disclosed for use by a right-handed golfer, it will be understood that such gloves can easily be configured for use by a left handed golfer. The right hand glove for the left-handed golfer would have all the attributes disclosed for the left hand glove of a right-handed golfer, only in a mirrored configuration.

Figure 7:
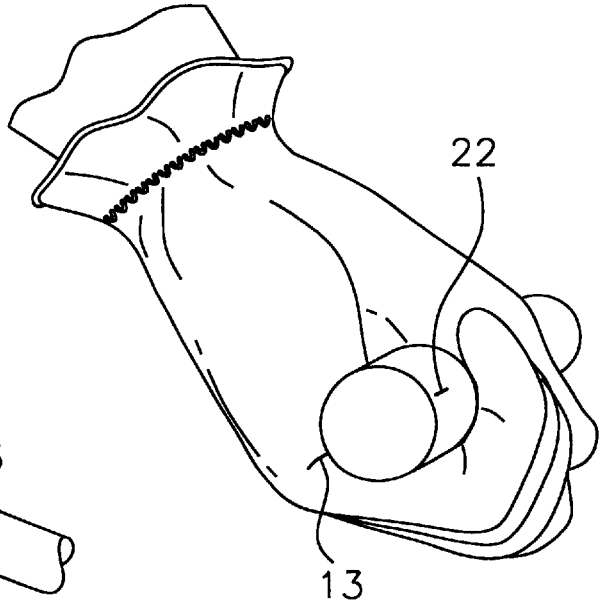
FIG. 7 is a perspective view of the upper gripping hand glove gripping on the handle showing the indicia on the grip handle opposite the guide line on the glove.
Figure 6D:
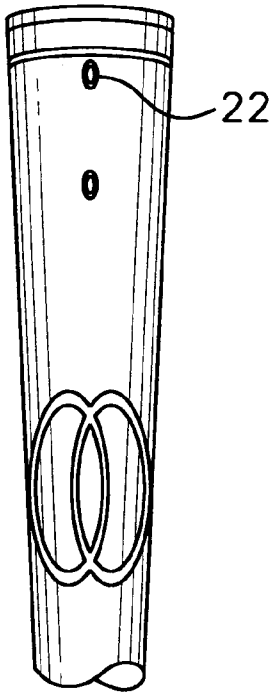
FIGS. 6*a*–*d* are plan views of several grip handles with a variety of indicia.
Figure 6C:
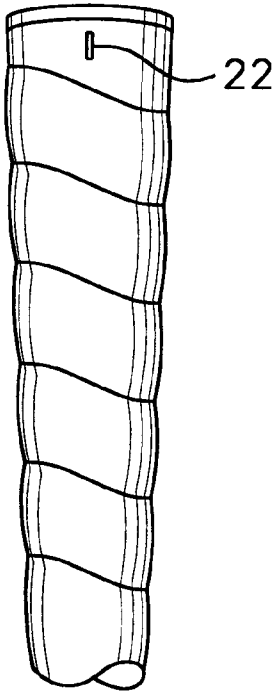
Figure 6B:
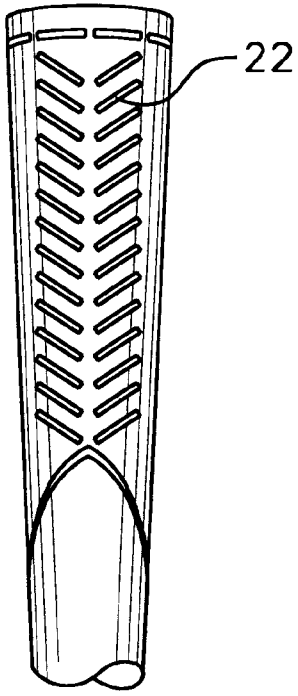
Figure 6A:
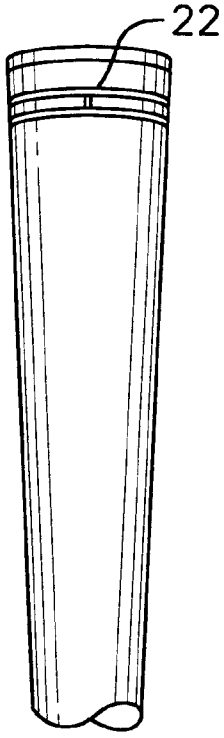

Proper gripping of the golf club handle by the wearer of the golf glove is facilitated by proper initial positioning of the club handle in the manner illustrated. The wearer of the golf glove having a guide line, receives a grip handle 18 on the anterior surface of the glove; superimposes the grip handle 18 longitudinally over the guide line 13 on the anterior surface of the glove thereby resting the club grip handle on the guide line; and positions the indicium or indicia 22 on the grip handle in a direction facing the wearer at approximately 180 degrees from the guide line 13 before gripping the club. The right or ungloved hand then grips the upper gripping hand and the grip handle usually by overlapping or interlocking the small finger of the ungloved hand with the index- finger of the upper gripping hand while the grip handle of the club is almost entirely covered by the gloved left hand. Prior to swing, the player makes a quick glance on the upper gripping hand to insure that proper position of the indicium/indicia in relation to the guide line as described above, is maintained as shown in FIG. 7. By positioning the grip handle in this manner, proper positioning of the club handle in the upper gripping hand of the wearer is assured. This provides a simple procedure for guiding the upper gripping hand on proper grip and position.

The glove of this invention, although catering more to a novice, can be used by a seasoned player or golfer for occasionally checking proper alignment of the golf club and his swings.

The foregoing detailed description were given primarily for clarity of understanding. It is therefore shown that the objects set forth above have been met and since certain changes may and can be made in relation to the disclosed invention, it is intended that all matter contained in the above description or shown in the accompanying drawings shall be interpreted as illustrative and not in a limiting sense.

I claim:

1. A golf glove for use in combination with an indicium on a golf club grip handle to achieve proper grip comprising:

a glove having an anterior and posterior surface, and a finger portion including an index finger, a middle finger, a ring finger, a little finger and a thumb having a crook between adjacent root of the finger portion; and, a plain or designed straight guide line having a thickness of less than one centimeter positioned diagonally across the anterior surface of the glove, the guide line passing through the crook between adjacent roots of the middle finger and the ring finger and slopes at an angle of 20–30 degrees from a phantom straight line drawn horizontally across the anterior surface of the golf glove.

2. The golf glove of claim 1, wherein the guide line underlie the indicium on the golf club grip handle at approximately 180 degree position from the indicium.

3. The golf glove of claim 1, wherein the guide line is represented by at least three plain dots having a midpoint.

4. The golf glove of claim 1, wherein the guide line is of a contrasting color from that of the glove.

5. The golf glove of claim 1, wherein the glove is sized to a wearer.

6. The golf glove of claim 1, wherein the guide line is represented by at least three designs having a midpoint.

7. The golf glove of claim 1, wherein the finger portion is not fully covered thereby forming a partial glove.

8. A method for achieving a proper golf grip position using a guideline on a golf glove in combination with an indicium of a golf grip handle, comprising the steps of:

wearing the golf glove having an anterior and posterior surface, and a finger portion including an index finger, a middle finger, a ring finger, a little finger and a thumb having a crook between adjacent root of the finger portion; and, a guide line positioned diagonally across the anterior surface of the glove, the guide line passing through the crook between adjacent roots of the middle finger and the ring finger and slopes at an angle of 20–30 degrees from a phantom straight line drawn horizontally across the anterior surface of the golf glove;

receiving a grip handle of a golf club having an indicium on the grip handle;

superimposing the grip handle longitudinally over the guide line on the anterior surface of the glove;

positioning the indicium on the grip handle in a direction facing a wearer at approximately 180 degrees from the guide line; and, gripping the handle of the golf club with the upper gripping hand responsive to the visual indication of the proper hand placement provided by the guide line on the glove and the indicium on the grip handle.

9. The method of claim 8 further comprising the step of glancing at the upper gripping hand to check proper positioning of the indicium in relation to the guide line prior to swing.

10. A golf glove for use in combination with an indicium on a golf club grip handle to achieve proper grip comprising:

a glove having an anterior and posterior surface, and a finger portion including an index finger, a middle finger, a ring finger, a little finger and a thumb having a crook between adjacent root of the finger portion; and, a guide line having a thickness of less than 5 millimeter, positioned diagonally across the anterior surface of the glove, the guide line passing through the crook between adjacent roots of the middle finger and the ring finger, and slopes at an angle of 20–30 degrees from a phantom straight line drawn horizontally across the anterior surface of the golf glove.

* * * * *